US006720867B2

(12) United States Patent
Baker

(10) Patent No.: US 6,720,867 B2
(45) Date of Patent: Apr. 13, 2004

(54) METHOD AND APPARATUS FOR ALERTING BASKETBALL FANS OF SUCCESSFUL THREE POINT SHOTS

(76) Inventor: David E. Baker, 2001 Boston St., Muskogee, OK (US) 74401-5228

( * ) Notice: Subject to any disclaimer, the term of this patent is extended or adjusted under 35 U.S.C. 154(b) by 40 days.

(21) Appl. No.: 10/008,816

(22) Filed: Nov. 3, 2001

(65) Prior Publication Data

US 2002/0060628 A1 May 23, 2002

Related U.S. Application Data

(60) Provisional application No. 60/248,971, filed on Nov. 15, 2000, and provisional application No. 60/311,886, filed on Aug. 13, 2001.

(51) Int. Cl.[7] ..... G08B 23/00; G08B 25/08

(52) U.S. Cl. ..... 340/323 R; 340/692; 340/825.69; 358/335

(58) Field of Search ..... 340/434, 815.4, 340/384.1, 323 R, 323 B, 825.69, 825.72, 539, 692; 273/317.3; 358/335

(56) References Cited

U.S. PATENT DOCUMENTS 3,651,507 A * 3/1972 Abbott ..... 340/323 R
4,541,013 A * 9/1985 Alpert ..... 348/601
5,065,251 A * 11/1991 Shuhart et al. ..... 386/96
5,745,029 A * 4/1998 Garcia ..... 340/323 R

* cited by examiner

*Primary Examiner*—Jeffery Hofsass
*Assistant Examiner*—Lam Pham
(74) *Attorney, Agent, or Firm*—Martin S. High

(57) ABSTRACT

The instant invention provides a method and apparatus for basketball referees, game management staff and other officials to notify the audience of a basketball game of the successful completion of a three-point shot. The preferred apparatus generates a tone that may be reproduced on the stadium or arena public address system or on the stadium or arena scoreboard or large screen video device. The tone generated by the apparatus is a unique sound that is readily recognized by the audience. The method involves a official, either an on-floor basketball official or an official observing the game from the side of the floor, activating a sound producing electronic card and the sound is then reproduced over the arena or stadium public address system. The major purpose of the method and device is to increase the enjoyment of observing basketball games by providing an audible alert to the successful completion of a three-point shot.

6 Claims, 9 Drawing Sheets

Schematic of Plastic Enclosure of Three-Point Shot Alerting Device

Schematic of Plastic Enclosure of Three-Point Shot Alerting Device

Electrical Schematic of the Sound Processing Card

Top Layer Overlay Schematic

Top Solder Mask Schematic

Top Layer Schematic

Bottom Layer Schematic

Top Solder Mask

Bottom Solder Mask

Drill Drawing for Through Holes Schematic

METHOD AND APPARATUS FOR ALERTING BASKETBALL FANS OF SUCCESSFUL THREE POINT SHOTS

CROSS-REFERENCE TO RELATED APPLICATIONS

This invention claims benefit of U.S. Provisional Application No. 60/248,971, which was filed on Nov. 15, 2000, and U.S. Provisional Application No. 60/311,886, which was filed on Aug. 13, 2001.

BACKGROUND OF THE INVENTION

1. Field of the Invention

The instant invention relates to the information provided to the audience of all levels of basketball games: preparatory school, high school, junior college, collegiate, Olympic, semi-professional, and professional basketball leagues. The field of the instant invention is also not limited to basketball games in the United States of America, but includes games played under rules promulgated by international basketball governing authorities.

2. Background

Basketball is a game played indoors on a wooden court with five players from two teams attempting to score the most points by throwing or tossing a ball, commonly called shooting the ball, into a basketball goal. The position of the player on the court ultimately determines the point value of successfully shooting the ball into and through the basketball goal. Painted permanently onto the wooden basketball court is curve that is fixed distance from the from the basketball goal (19 feet, 9 inches for high school level and for the collegiate level; and 23 feet, 9 inches for the National Basketball Association; other distances will apply for other basketball governing organizations), this painted curve is termed the three-point line. A player who is located between the three-point line and the goal and who successfully shoots a goal earns two points for his or her team. If a player is located behind the three-point line (the three point line is between the goal and the player) when shooting the basketball towards the goal, and the goal is successful, the player's team receives three points. Under current rules of basketball, one or more referees in the game signal the awarding of the three points by holding both arms straight and vertically above the head. Currently, this and the resulting addition of three points to the team's score on a scoreboard are the only official signals of completion of a three-point shot.

The purpose of the instant invention is to provide an audible or additional visual signal to the audience of the basketball game of the successful completion of the three-point shot that will complement the visual signal provided by the referees of the game.

SUMMARY OF THE INVENTION

Broadly speaking, the instant invention provides a method and apparatus for increasing the enjoyment of basketball games by the audience by indicating when a three-point shot has been successful. In addition, the invention provides feedback to the game officials, players and coaches that the three-point shot has been successful. Furthermore, the invention provides assistance to television and radio commentators identifying successful three-point shots. Finally, the invention provides opportunities for advertisements.

The instant invention uses a unique sound to signal the audience of a basketball game that a player has successfully completed a three-point shot. One example of a unique sound that can be employed is one comprised of the musical notes: E-G-C. These three musical notes can be produced by any tone-generating device such as, but not limited to, acoustic instruments, electronic instruments or electronic music synthesizers. However, this three note sequence, although it is disclosed in one of the preferred embodiments of the instant invention should not be meant to limit the range of choices available for unique tones or notes to be sounded.

In one preferred embodiment, the instant invention is comprised of a sound-producing card enclosed in a plastic housing. The plastic housing contains connections for a standard audio cable for connection to the arena or stadium public address system. The plastic housing contains a hole through which a play switch or button is inserted to activate the sound-producing card. The game official responsible for the three-point notification presses the button to generate the sound. The plastic housing also contains a 9 Volt regulator power pack to energize the sound card in the plastic housing which is powered by standard 10 V AC current. Holes are also provided in the plastic enclosure for light emitting diodes to indicate status of power and record/playback mode.

The sound card is designed to record, store, and playback digital sound. It is a self-contained unit that only requires a +9 Volt power source, typically a wall transformer, and an external amplifier/speaker system to provide the amplified sound.

Recordings are stored in non-volatile memory cells providing protected, no-power recording storage. Up to 20 seconds of sound can be stored. The sampling rate is 6.4 kHz with a band pass filter set at 2.6 kHz, providing high-quality audio reproduction. Recorded sounds have a typical 100-year retention and over 100,000 new recordings can be performed. Sound is output at standard audio line level (1V peak-to-peak).

The onboard controls allow for recording and playback in development mode. An external playback switch connection point is provided for user control. Light emitting diodes indicate record/playback mode and unit power status. User playback is initiated simply by pressing the external play switch. Although additional presses of the play switch while the unit is playing the pre-recorded sound have no effect, once the sound is completed it can be immediately started again by pressing the play switch.

Additional features include test points on the power rails and record input and line-level output adjustment potentiometers provided for fine-tuning the signal levels.

DETAILED DESCRIPTION OF THE PREFERRED EMBODIMENTS

Figure 1:
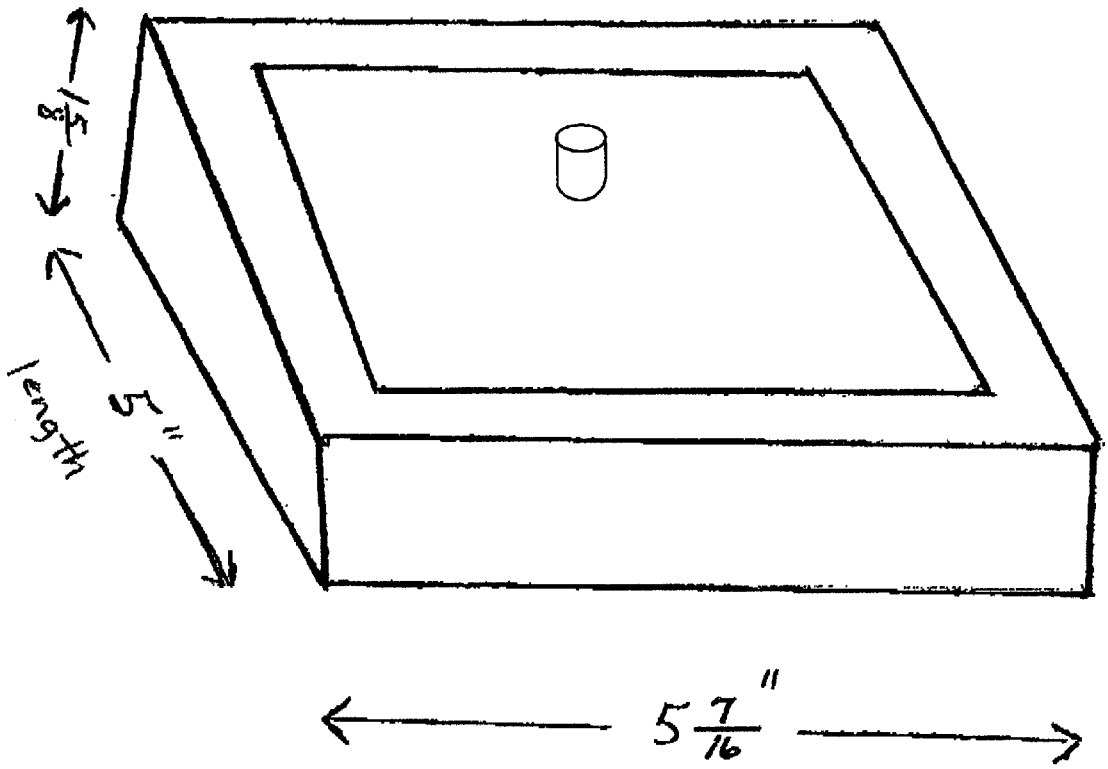
FIG. 1 provides a schematic of the plastic enclosure for the Three-Point Shot Alerting Device.
Figure 2:
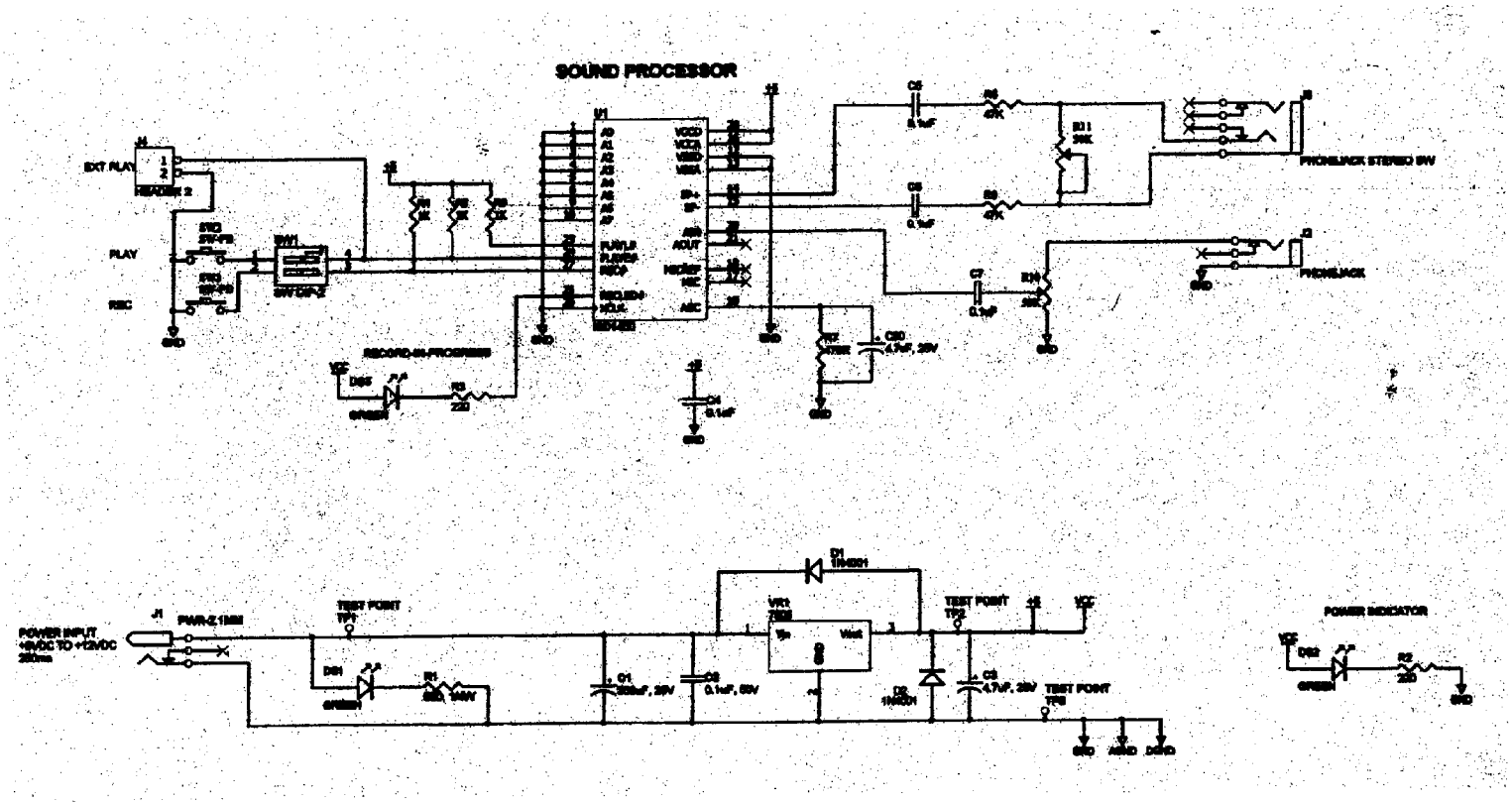
FIG. 2 provides an electrical schematic of the sound processor card. This sound processor card is contained in the plastic housing.
Figure 3:
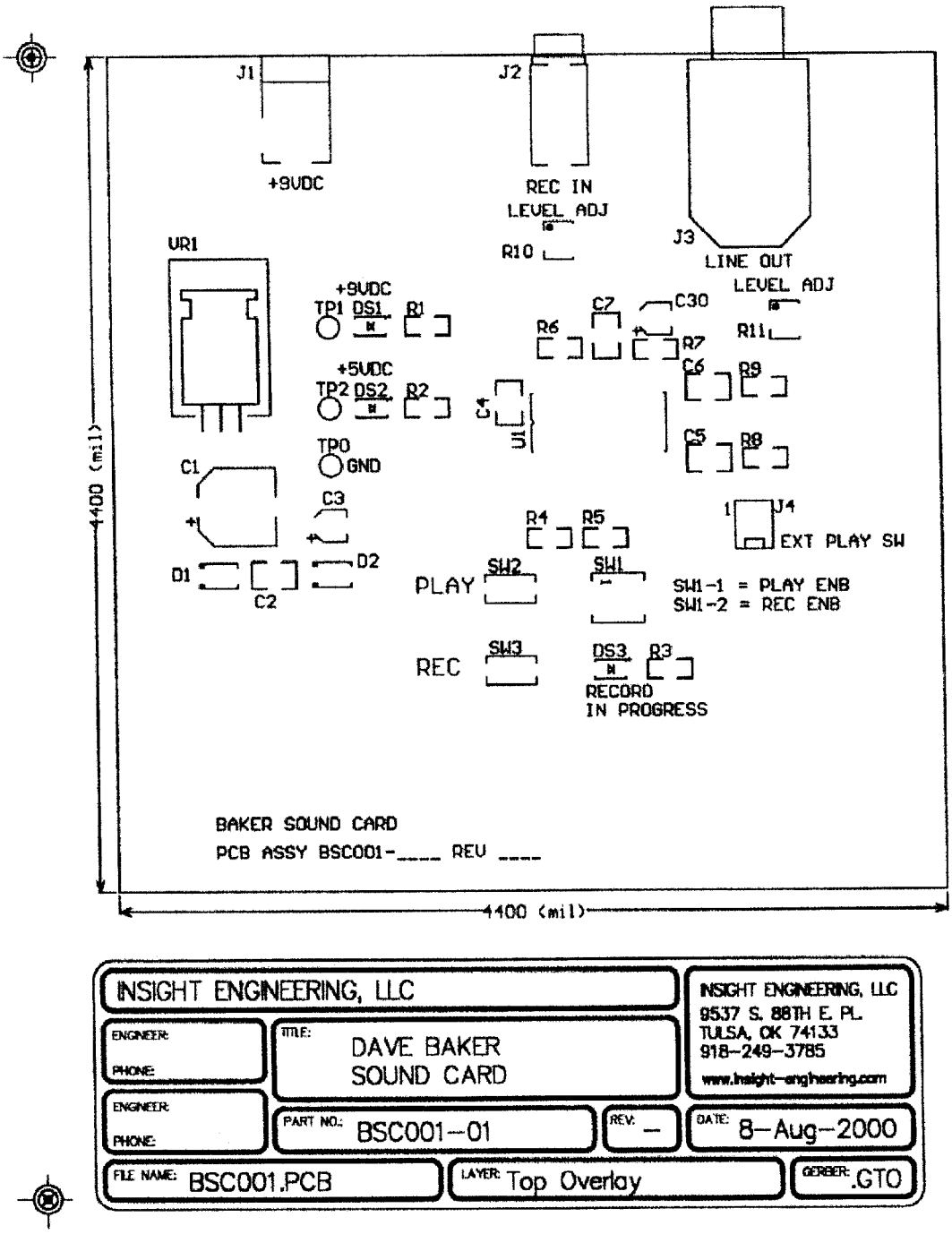
FIG. 3 is a top layer overlay schematic.
Figure 4:
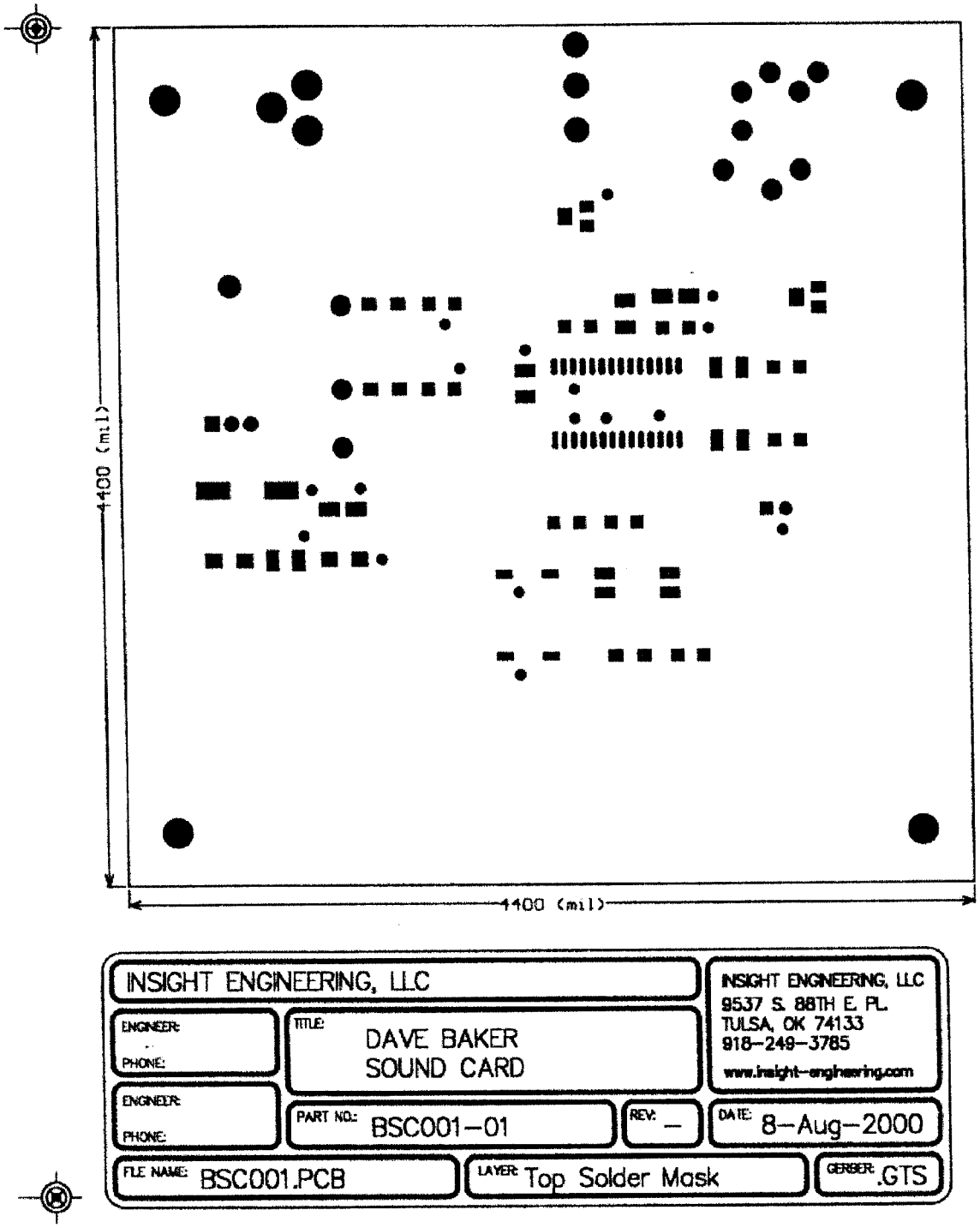
FIG. 4 is a top solder mask schematic.
Figure 5:
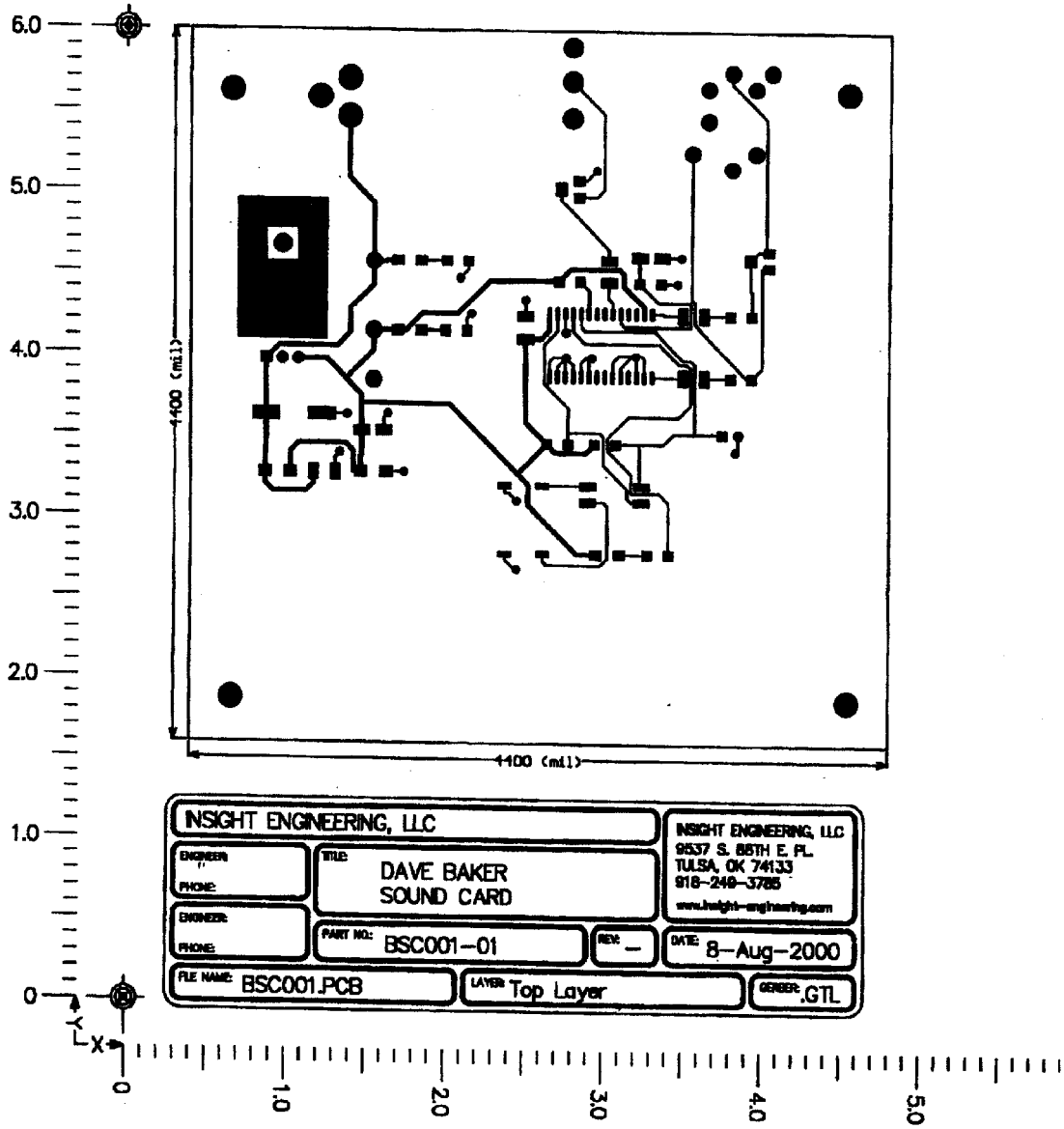
FIG. 5 is a top layer schematic.
Figure 6:
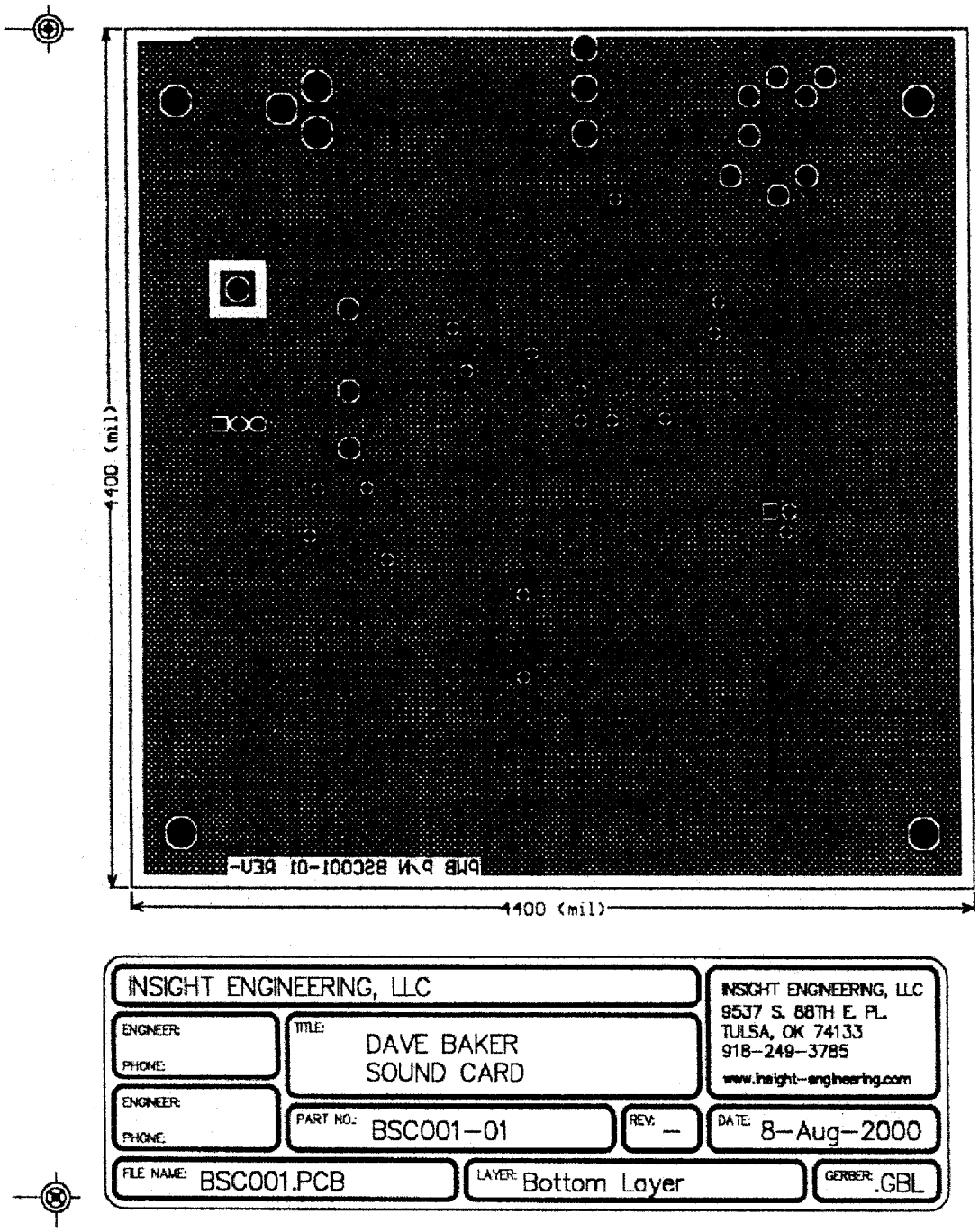
FIG. 6 is a bottom layer schematic.
Figure 7:
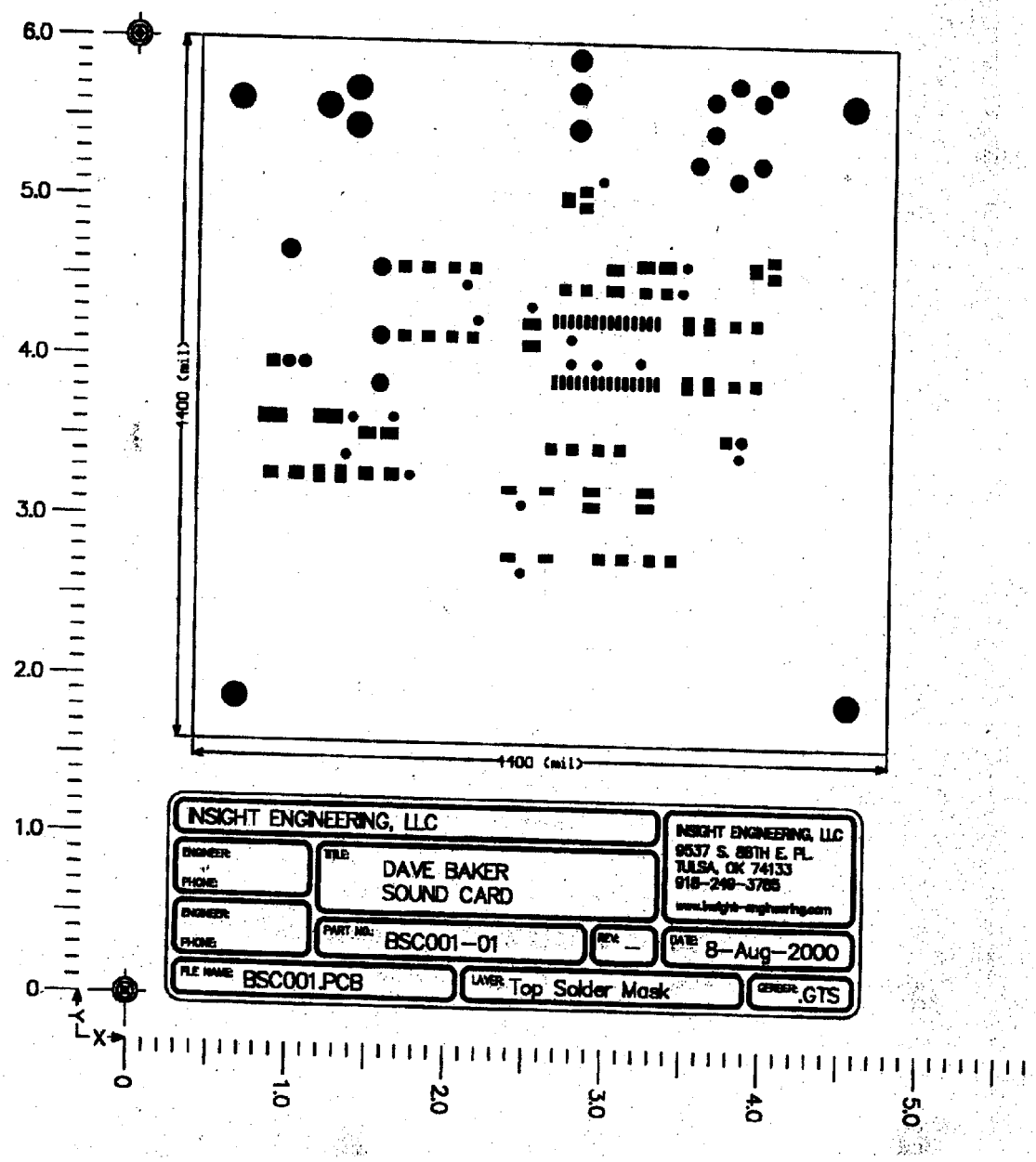
FIG. 7 is a top solder mask.
Figure 8:
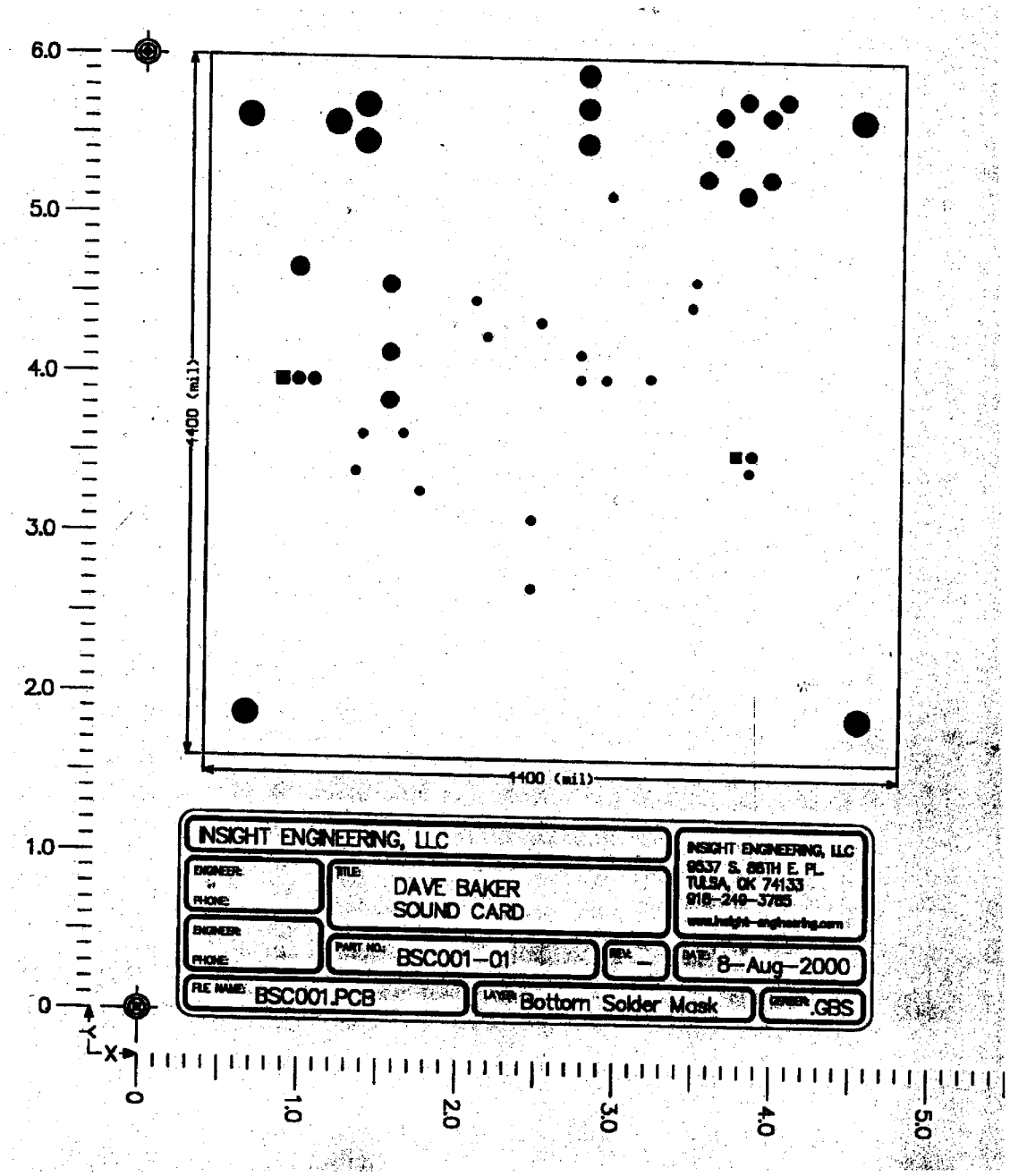
FIG. 8 is a bottom solder mask.
Figure 9:
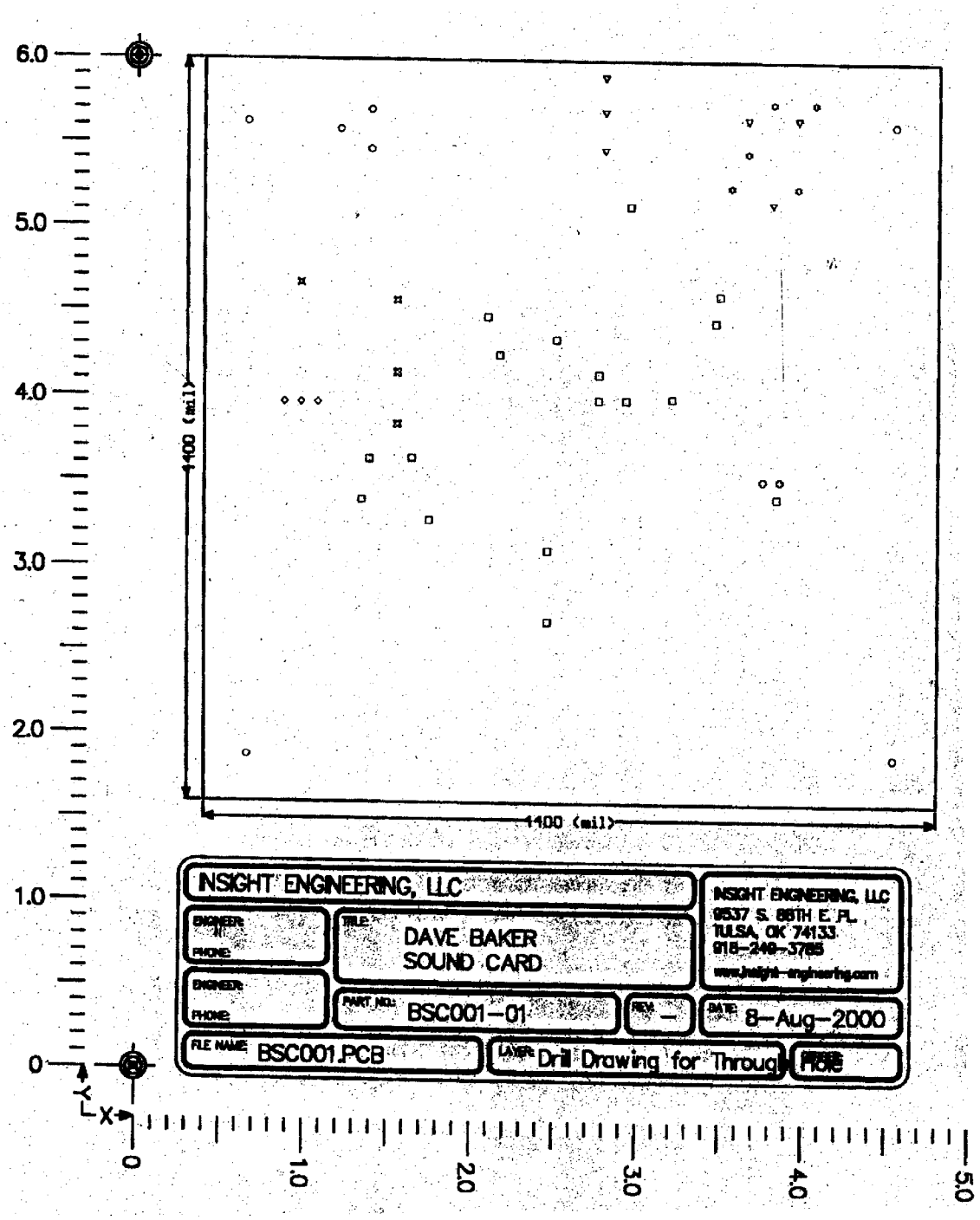
FIG. 9 is a drill drawing for through holes schematic

The instant invention is comprised of a sound processor electronic device that can be connected to a stadium, arena, or auditorium public address system and can generate an audible, easily identifiable, unique sound or tone to alert the audience of a basketball game of the successful completion of a three-point shot.

The preferred embodiment of the instant invention would be to locate the plastic enclosure containing the sound card on the official scoring table of the basketball game. The arena or stadium public address system is in turn connected to the sound card through the standard connection located on the side of the plastic enclosure. When the on-court official signals the successful completion of a three point shot, by raising both of his arms above his head, the official scorer on the side of the court would actuate the three-point alarm system by depressing the button on the plastic enclosure. The unique tone or sound would then be generated by the sound-processing card and reproduced on the public address system of the stadium, arena, or auditorium.

One example of a unique sound that can be employed is one comprised of the musical notes: E-G-C. These three musical notes can be produced by any tone-generating device such as, but not limited to, acoustic instruments, electronic instruments or electronic music synthesizers. However, disclosure of this three note sequence as a preferred embodiment of the instant invention does not limit the range of choices available for unique tones or notes to be sounded.

An alternative embodiment of the invention would be to have the on-court official actuate the sound-processing card remotely. This can be easily accomplished by integrating a remote control device that can actuate the sound card located on the official scorers table. This remote control device could be incorporated into the official's whistle or other handheld object.

An additional embodiment of the invention includes activation of a light or other visual alarm that is located within the line of sight of the majority of the fans of the basketball game. Once the official actuates the sound-processing mechanism, a signal is also sent to the light actuation mechanism to turn on the light or visual alarm. The light or visual alarm could be mounted at various locations throughout the basketball arena including, but not limited to, on the main scoreboard, on the auxiliary scoreboards common in basketball areans, on the scorers table, or on the basketball goal backboard.

One final embodiment of the invention includes activation of a pre-recorded display or animation that can be played on the video monitor, sometimes termed a "jumbotron," that is now common in professional and collegiate basketball facilities. The pre-recorded display or animation could include team-specific information that indicates the successful completion of the three-point shot.

What is claimed is:

1. A method for alerting basketball fans and participants of the successful completion of a three point shot comprising:

(a) initiating the operation of the process by a game official by activating an electromechanical switch, button or contact which is located in the proximity of the official on the field of play, or in the proximity of an official near the field of play, or in the proximity of officials on the field of play and near the field of play;

(b) initiating the operation of the process initiates a step for generating an electronically produced sequence of two or more musical notes, a sequence of two or more musical tones;

(c) initiating the operation of the process initiates a step for interfacing to a public address or other sound reproduction system;

(d) initiating the operation of the process initiates a means for interfacing to a visual display device viewable by all of the participants and observers of a game including on-site observers and remote observers via television.

2. The method for alerting basketball fans and participants of the successful completion of a three point shot as described in claim 1 wherein the sequence of musical notes is comprised of the sequence of musical notes E, G, C.

3. The method for alerting basketball fans and participants of the successful completion of a three point shot as described in claim 2 wherein the step of interfacing to a visual display device including a scoreboard or large screen television monitor is accomplished via an electrical signal provided at a cable jack (J3 or J2).

4. A device for alerting basketball fans and participants of the successful completion of a three point shot comprising:

(a) electromechanical switch, button or contact which is located in the proximity of the official on the field of play, or in the proximity of an official near the field of play, or in the proximity of officials on the field of play and near the field of play;

(b) a device for generating an electronically produced sequence of two or more musical notes, a sequence of two or more musical tones;

(c) a device for interfacing to a public address or other sound reproduction system;

(d) a device for interfacing to a visual display device viewable by all of the participants and observers of a game including on-site observers and remote observers via television.

5. The device for alerting basketball fans and participants of the successful completion of a three point shot as described in claim 4 wherein the sequence of musical notes is comprised of the sequence of musical notes E, G, C.

6. The device for alerting basketball fans and participants of the successful completion of a three point shot as described in claim 5 wherein the device for interfacing to a visual display device further comprises a device to interface to a game scoreboard or large screen television monitor is accomplished via an electrical signal provided at a cable jack (J3 or J2).

* * * * *